US008223082B2

(12) United States Patent
Chiang et al.

(10) Patent No.: US 8,223,082 B2
(45) Date of Patent: Jul. 17, 2012

(54) SLOT ANTENNAS FOR ELECTRONIC DEVICES

(75) Inventors: Bing Chiang, Cupertino, CA (US); Douglas Blake Kough, San Jose, CA (US); Enrique Ayala Vazquez, Watsonville, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/286,845

(22) Filed: Nov. 1, 2011

(65) Prior Publication Data

US 2012/0044116 A1 Feb. 23, 2012

Related U.S. Application Data

(62) Division of application No. 12/101,121, filed on Apr. 10, 2008, now Pat. No. 8,077,096.

(51) Int. Cl.
*H01Q 13/10* (2006.01)

(52) U.S. Cl. ..... 343/767; 343/700 MS; 343/846

(58) Field of Classification Search ..... 343/700, 343/767, 770, 829, 846
See application file for complete search history.

(56) References Cited

U.S. PATENT DOCUMENTS

| | | | | |
|---|---|---|---|---|
| 4,130,822 | A | 12/1978 | Conroy | |
| 4,682,180 | A | 7/1987 | Gans | |
| 4,853,704 | A | 8/1989 | Diaz et al. | |
| 4,873,529 | A | 10/1989 | Gibson | |
| 5,568,159 | A | 10/1996 | Pelton et al. | |
| 5,581,266 | A | 12/1996 | Peng et al. | |
| 5,966,101 | A | 10/1999 | Haub et al. | |
| 6,452,552 | B1 * | 9/2002 | Ishitobi et al. | 343/700 MS |
| 6,466,176 | B1 | 10/2002 | Maoz et al. | |
| 6,492,947 | B2 * | 12/2002 | Anderson | 343/700 MS |
| 6,788,266 | B2 | 9/2004 | St. Hillaire et al. | |
| 7,075,493 | B2 | 7/2006 | Azadegan et al. | |
| 7,227,506 | B1 * | 6/2007 | Lewis, Jr. | 343/767 |
| 2004/0164916 | A1 * | 8/2004 | Jecko et al. | 343/767 |
| 2005/0078037 | A1 | 4/2005 | Leclerc et al. | |
| 2005/0110686 | A1 | 5/2005 | Frederik du Toit | |
| 2009/0153411 | A1 | 6/2009 | Chiang et al. | |

OTHER PUBLICATIONS

G. Lee et al. "Size reduction of microstrip-fed slot antenna by inductive and capacitive loading", Jun. 2003 IEEE Antennas and Propagation Society International Symposium, pp. 312-315.

* cited by examiner

*Primary Examiner* — Tho G Phan
(74) *Attorney, Agent, or Firm* — Treyz Law Group; G. Victor Treyz; David C. Kellogg

(57) ABSTRACT

Slot antennas are provided for electronic devices such as portable electronic devices. The slot antennas may have a dielectric-filled slot that is formed in a ground plane element. The ground plane element may be formed from part of a conductive device housing. The slot may have one or more holes at its ends. The holes may affect the impedance characteristics of the slot antennas so that the length of the slot antennas may be reduced. For example, the holes can be used to synthesize the impedance of the slot antennas so that the slot antennas have a resonant frequency that is different from their natural resonant frequency. The holes may affect the impedance of the slot antennas in multiple radio-frequency bands.

18 Claims, 10 Drawing Sheets

SLOT ANTENNAS FOR ELECTRONIC DEVICES

This application is a division of patent application Ser. No. 12/101,121, filed Apr. 10, 2008, now U.S. Pat. No. 8,077,096 which is hereby incorporated by reference herein in its entirety.

BACKGROUND

This invention relates to antennas, and more particularly, to slot antennas for electronic devices such as portable electronic devices.

Due in part to their mobile nature, portable electronic devices are often provided with wireless communications capabilities. Portable electronic devices may use wireless communications to communicate with wireless base stations. For example, cellular telephones communicate using cellular telephone bands at 850 MHz, 900 MHz, 1800 MHz, and 1900 MHz (e.g., the main Global System for Mobile Communications or GSM cellular telephone bands). Portable electronic devices can also use other types of communications links. For example, portable electronic devices such as laptop computers communicate using the Wi-Fi® (IEEE 802.11) bands at 2.4 GHz and 5 GHz and the Bluetooth® band at 2.4 GHz. Communications are also possible in data service bands such as the 3G data communications band at 2100 MHz band (commonly referred to as UMTS or Universal Mobile Telecommunications System).

To satisfy consumer demand for small form factor wireless devices, manufacturers are continually striving to reduce the size of components that are used in these devices. For example, manufacturers have made attempts to miniaturize the antennas used in portable electronic devices.

A typical antenna can be fabricated by patterning a metal layer on a circuit board substrate or can be formed from a sheet of thin metal using a foil stamping process. These techniques can be used to produce antennas that fit within the tight confines of a compact portable device such as a handheld electronic device. With conventional portable electronic devices, however, design compromises are made to accommodate compact antennas. These design compromises can include, for example, compromises related to antenna efficiency and antenna bandwidth.

It would therefore be desirable to be able to provide improved antennas for electronic devices such as portable electronic devices.

SUMMARY

Slot antennas with enlarged ends are provided for electronic devices such as portable electronic devices. The slot antennas can be shorter in length than comparable slot antennas with conventional terminations. The electronic devices can be portable electronic devices such as laptop computers. The slot antennas may have dielectric-filled openings that are formed in a ground plane element. The dielectric-filled openings can be filled with air, plastic, epoxy, or other dielectrics.

The ground plane element may be formed from a conductor on a printed circuit board or other suitable conductive structure. With one suitable arrangement, the ground plane element is formed from a conductive housing for an electronic device.

The enlarged ends of the slot antennas serve as inductive terminations. These terminations can be used to optimize the impedance of the slot antennas.

A slot antenna can have two enlarged ends that are different in size. A slot may be fed at a feed point that is not equidistant from the ends of the slot.

Further features of the invention, its nature and various advantages will be more apparent from the accompanying drawings and the following detailed description of the preferred embodiments.

DETAILED DESCRIPTION

The present invention relates generally to antennas, and more particularly, to slot antennas with enlarged terminations for wireless electronic devices such as laptop computers. The enlarged terminations may be, for example, circular holes located at the ends of the slot antennas.

The wireless electronic devices may be any suitable electronic devices. As an example, the wireless electronic devices can be desktop computers or other computer equipment. The wireless electronic devices may also be portable electronic devices such as portable computers also known as laptop computers or small portable computers of the type that are sometimes referred to as ultraportables. Portable electronic devices may also be somewhat smaller devices. Examples of smaller portable electronic devices include personal accessory devices capable of being worn, carried, or otherwise attached to the body such as arm and wrist band devices, pendant devices, headphone and earpiece devices, and other wearable and miniature devices. In one embodiment, the portable electronic devices may be handheld electronic devices.

Examples of portable and handheld electronic devices include cellular telephones, media players with wireless communications capabilities, handheld computers (also sometimes called personal digital assistants), remote controls, global positioning system (GPS) devices, and handheld gaming devices. The devices may also be hybrid devices that combine the functionality of multiple conventional devices. Examples of hybrid devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

Figure 1:
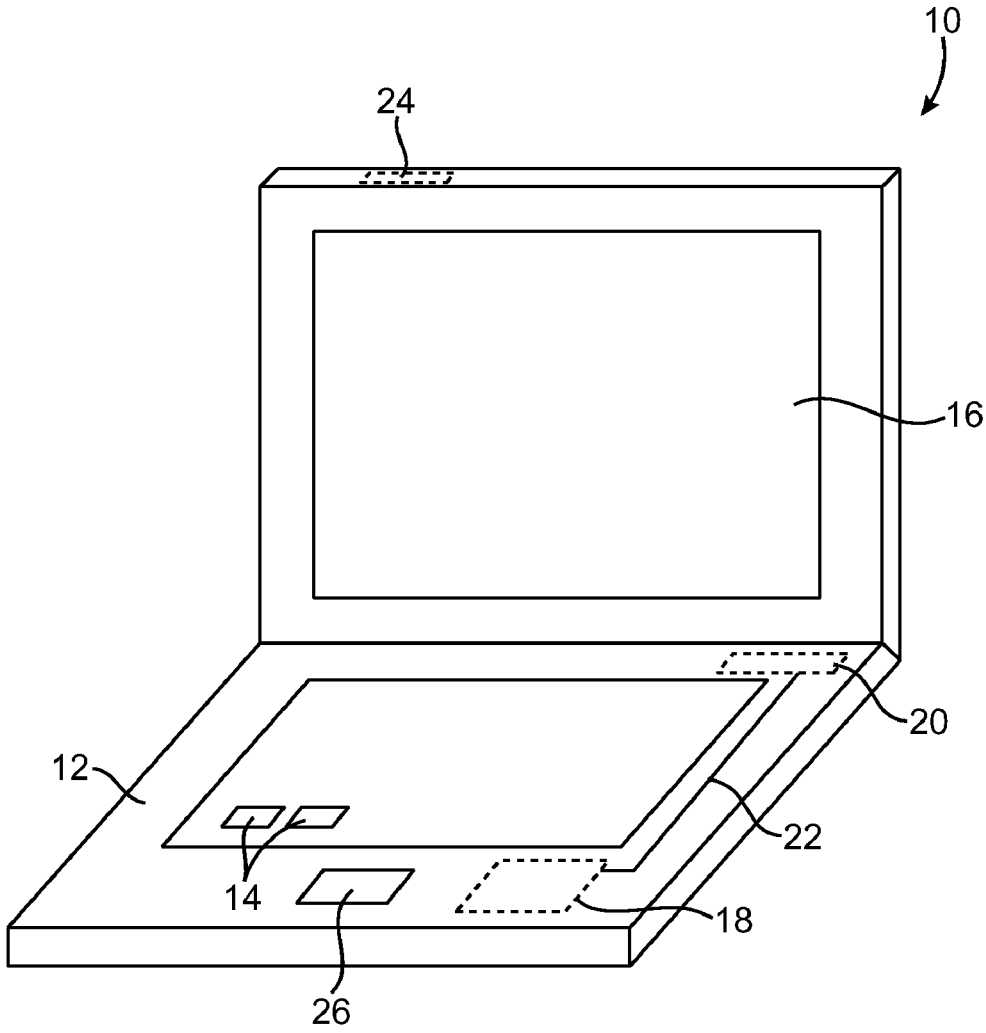
FIG. 1 is a perspective view of an illustrative electronic device such as a portable electronic device in accordance with an embodiment of the present invention.

An illustrative electronic device such as a portable electronic device in accordance with an embodiment of the present invention is shown in FIG. 1. Device 10 may be any suitable electronic device. As an example, device 10 can be a laptop computer.

Device 10 may handle communications over one or more communications bands. For example, wireless communications circuitry in device 10 can be used to handle cellular telephone communications in one or more frequency bands and data communications in one or more communications bands. Typical data communications bands that may be handled by the wireless communications circuitry in device 10 include the 2.4 GHz band that is sometimes used for Wi-Fi® (IEEE 802.11) and Bluetooth® communications, the 5 GHz band that is sometimes used for Wi-Fi communications, the 1575 MHz Global Positioning System band, and 3G data bands (e.g., the UMTS band at 1920-2170). These bands may be covered by using single and multiband antennas. For example, cellular telephone communications can be handled using a multiband cellular telephone antenna and local area network data communications can be handled using a multiband wireless local area network antenna. As another example, device 10 may have a single multiband antenna for handling communications in two or more data bands (e.g., at 2.4 GHz and at 5 GHz).

Device 10 has housing 12. Housing 12, which is sometimes referred to as a case, may be formed of any suitable materials including plastic, glass, ceramics, metal, other suitable materials, or a combination of these materials. In some situations, housing 12 or portions of housing 12 may be formed from a dielectric or other low-conductivity material, so as not to disturb the operation of conductive antenna elements that are located in proximity to housing 12.

Housing 12 or portions of housing 12 may also be formed from conductive materials such as metal. An illustrative metal housing material that can be used is anodized aluminum. Aluminum is relatively light in weight and, when anodized, has an attractive insulating and scratch-resistant surface. If desired, other metals can be used for the housing of device 10, such as stainless steel, magnesium, titanium, alloys of these metals and other metals, etc. In scenarios in which housing 12 is formed from metal elements, one or more of the metal elements can be used as part of the antenna in device 10. For example, metal portions of housing 12 and metal components in housing 12 may be shorted together to form a ground plane in device 10 or to expand a ground plane structure that is formed from a planar circuit structure such as a printed circuit board structure (e.g., a printed circuit board structure used in forming antenna structures for device 10).

Device 10 may have one or more keys such as keys 14. Keys 14 can be formed on any suitable surface of device 10. In the example of FIG. 1, keys 14 have been formed on the top surface of device 10. With one suitable arrangement, keys 14 form a keyboard on a laptop computer. Keys such as keys 14 may also be referred to as buttons.

If desired, device 10 may have a display such as display 16. Display 16 may be a liquid crystal diode (LCD) display, an organic light emitting diode (OLED) display, a plasma display, or any other suitable display. The outermost surface of display 16 may be formed from one or more plastic or glass layers. If desired, touch screen functionality can be integrated into display 16. Device 10 may also have a separate touch pad device such as touch pad 26. An advantage of integrating a touch screen into display 16 to make display 16 touch sensitive is that this type of arrangement can save space and reduce visual clutter. Keys 14 may, if desired, be arranged adjacent to display 16. With this type of arrangement, the buttons may be aligned with on-screen options that are presented on display 16. A user may press a desired button to select a corresponding one of the displayed options.

Device 10 includes circuitry 18. Circuitry 18 may include storage, processing circuitry, and input-output components. Wireless transceiver circuitry in circuitry 18 may be used to transmit and receive radio-frequency (RF) signals. Transmission lines (e.g., communications paths) such as coaxial transmission lines and microstrip transmission lines are used to convey radio-frequency signals between transceiver circuitry and antenna structures in device 10. As shown in FIG. 1, for example, transmission line 22 is used to convey signals between antenna structure 20 and circuitry 18. Communications path 22 (i.e., transmission line 22) can be, for example, a coaxial cable that is connected between an RF transceiver (sometimes called a radio) and a multiband antenna. Antenna structures such as antenna structure 20 may be located adjacent to keys 14 as shown in FIG. 1 or in other suitable locations. For example, antenna structures such as antenna structure 20 can be located on a housing edge or on the top surface of housing 12 (e.g., as illustrated by outline 24).

Figure 2:
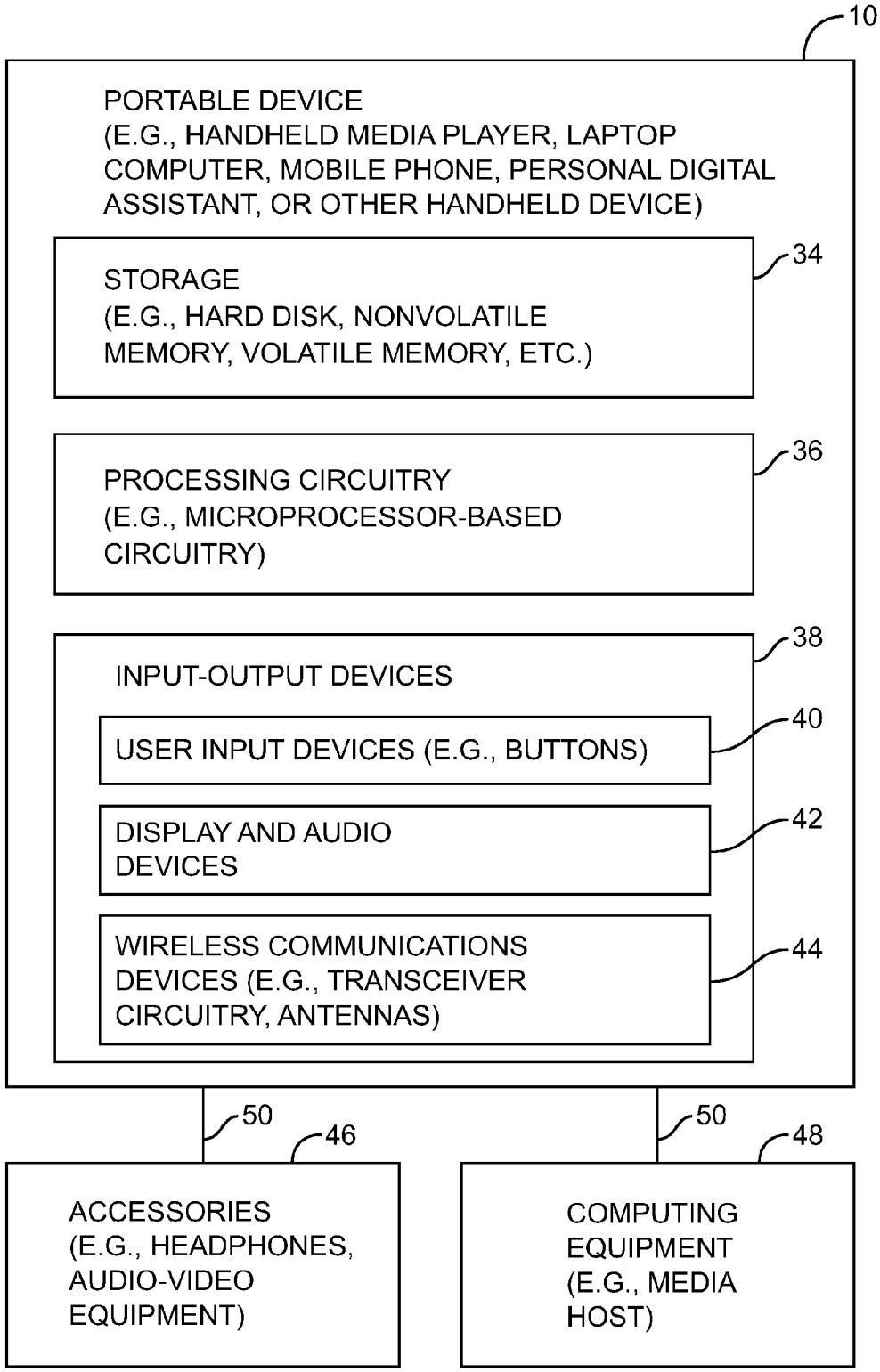
FIG. 2 is a schematic diagram of an illustrative electronic device in accordance with an embodiment of the present invention.

A schematic diagram of an embodiment of an illustrative electronic device such as a portable electronic device is shown in FIG. 2. Portable device 10 may be a laptop computer, a mobile telephone, a mobile telephone with media player capabilities, a handheld computer, a remote control, a game player, a global positioning system (GPS) device, a combination of such devices, or any other suitable portable or handheld electronic device.

As shown in FIG. 2, portable device 10 can include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 can be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as Wi-Fi®), protocols for other short-range wireless communications links such as the Bluetooth® protocol, protocols for handling 3G data services, cellular telephone communications protocols, etc.

Input-output devices 38 may be used to allow data to be supplied to device 10 and to allow data to be provided from device 10 to external devices. Display screen 16, keys 14, and touchpad 26 of FIG. 1 are examples of input-output devices 38.

Input-output devices 38 may include user input-output devices 40 such as buttons, touch screens, joysticks, click wheels, scrolling wheels, touch pads, key pads, keyboards, microphones, cameras, speakers, tone generators, vibrating elements, etc. A user can control the operation of device 10 by supplying commands through user input devices 40.

Display and audio devices 42 may include liquid-crystal display (LCD) screens or other screens, light-emitting diodes (LEDs), and other components that present visual information and status data. Display and audio devices 42 can also include audio equipment such as speakers and other devices for creating sound. Display and audio devices 42 may contain audio-video interface equipment such as jacks and other connectors for external headphones, speakers, microphones, monitors, etc.

Wireless communications devices 44 may include communications circuitry such as radio-frequency (RF) transceiver circuitry formed from one or more integrated circuits, power amplifier circuitry, passive RF components, one or more antennas (e.g., antenna structures such as antenna structure 20 of FIG. 1), and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content).

Computing equipment 48 may be any suitable computer. With one suitable arrangement, computing equipment 48 is a computer that has an associated wireless access point or an internal or external wireless card that establishes a wireless connection with device 10. The computer may be a server (e.g., an internet server), a local area network computer with or without internet access, a user's own personal computer, a peer device (e.g., another portable electronic device 10), or any other suitable computing equipment.

The antenna structures and wireless communications devices of device 10 can support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3G data communications band at 2100 MHz band (commonly referred to as UMTS or Universal Mobile Telecommunications System), Wi-Fi® (IEEE 802.11) bands (also sometimes referred to as wireless local area network or WLAN bands), the Bluetooth® band at 2.4 GHz, and the global positioning system (GPS) band at 1575 MHz. Wi-Fi bands that can be supported include the 2.4 GHz band and the 5 GHz bands. The 2.4 GHz Wi-Fi band extends from 2.412 to 2.484 GHz. Commonly-used channels in the 5 GHz Wi-Fi band extend from 5.15-5.85 GHz, so the 5 GHz band is sometimes referred to by the 5.4 GHz approximate center frequency for this range (i.e., these communications frequencies are sometimes referred to as making up a 5.4 GHz communications band). Device 10 can cover these communications bands and/or other suitable communications bands with proper configuration of the antenna structures in wireless communications circuitry 44.

Figure 3:
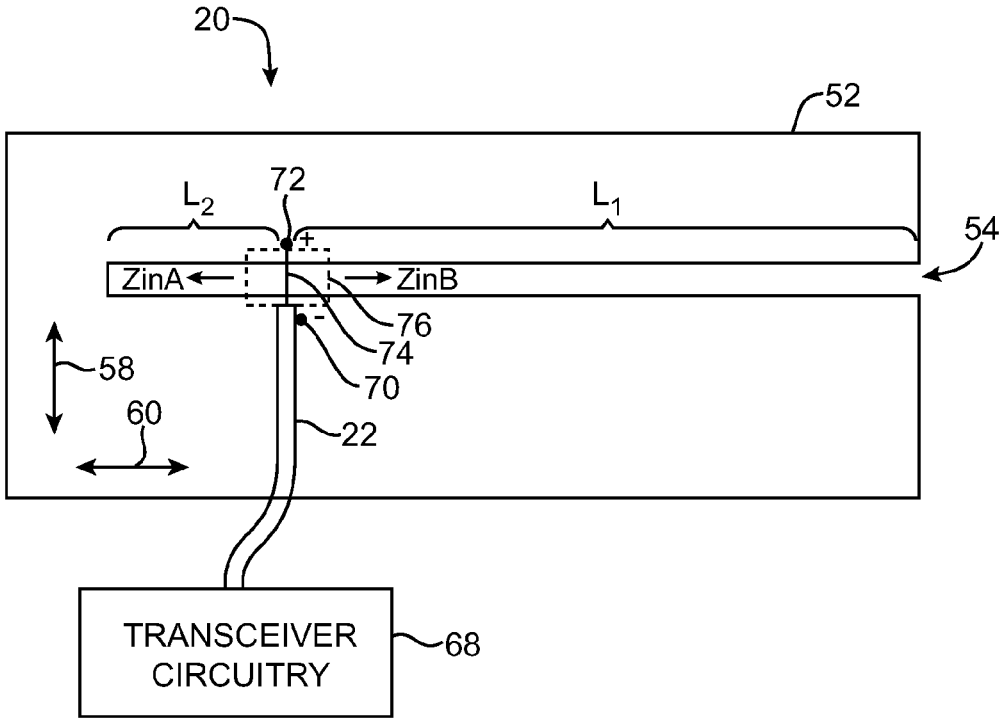
FIG. 3 is a top view of an illustrative slot antenna that has a short-circuit termination and an open circuit termination in accordance with an embodiment of the present invention.

A top view of an illustrative antenna structure is shown in FIG. 3. As shown in FIG. 3, antenna 20 is formed from a ground plane structure such as ground plane 52. An antenna element for antenna 20 is formed from an opening in ground plane 52 such as opening 54. Openings such as opening 54, which are sometimes referred to as slots, can be filled with air or other suitable dielectrics such as plastic or epoxy. With one suitable arrangement, slot 54 is substantially rectangular in shape and has a narrower dimension (i.e., a width measured parallel to lateral dimension 58) and a longer dimension (e.g., a length measured parallel to longitudinal dimension 60). If desired, slot 54 can also have a non-rectangular shape (such as shapes with non-perpendicular edges, shapes with curved edges, shapes with bends, etc.). The use of rectangular slot configurations is generally described herein as an example.

The width of slot 54 is generally much less than its length. For example, the width of slot 54 may be on the order of a tenth of a millimeter (e.g., 0.05-0.4 millimeters), whereas the length of slot 54 may be on the order of millimeters or centimeters (e.g., 10 mm or more). With one suitable arrangement, the length of slot is selected so that the slot has antenna resonances at desired operating frequencies. The length of slot 54 can, for example, be adjusted to be equal to a half of a wavelength at a desired operating frequency (for slots that are closed at both ends) or equal to a quarter of a wavelength (for slot structures that are open at one end). Slots that are closed at both ends are completely surrounded by ground plane elements and are therefore sometimes referred to as closed slots. When a slot has an end that is not covered by ground plane material (i.e., the dielectric in the slot is not enclosed on one side by ground plane material), that slot is sometimes said to have an open end or be an open slot.

Ground plane 52 may be formed from a printed circuit board, a planar metal structure, conductive electrical components, conductive housing walls, other suitable conductive structures, or combinations of these structures. With one suitable arrangement, one or more portions of housing 12 are used to form ground plane 52. It may be advantageous to form antennas such as antenna 20 from conductive housing structures such as a laptop computer housing because this type of arrangement provides good antenna performance in a device that has a metal housing.

Because slot antennas such as slot antenna 20 are typically small and may also be filled with dielectrics such as plastic or epoxy, the slot in antenna 20 can be designed to blend in with surrounding portions of device 10 (e.g., surrounding portions of housing 12). With one suitable arrangement, the color and texture of the dielectric used to fill slot 54 is similar to the color and texture of surrounding portions of device 10 so that slot 54 is invisible to the naked eye or may, at least, be barely noticeable under normal observation. This allows slot antenna 20 to be formed on normally exposed portions of housing 12. Examples of normally exposed housing portions include the exterior surfaces of a laptop computer or other device 10, surfaces of a laptop computer such as the housing surface adjacent to the keyboard or display (e.g., when the cover of a laptop computer has been opened for use), or housing sidewalls. When antenna 20 is formed on an exterior surface of device 10, antenna 20 will not generally be blocked by surrounding conductive materials (e.g., conductive housing walls). This allows antenna 20 to operate freely without requiring the formation of potentially unsightly and structurally weak dielectric windows (antenna caps) in device 10.

The slot of a slot antenna may be filled with a dielectric such as epoxy to prevent intrusion of liquids, dust, or other foreign matter. This type of filling arrangement can be particularly advantageous in situations in which antenna 20 is formed on a metal wall or other exterior surface of housing 12 where antenna 20 is exposed to the environment.

Slots such as slot 54 may be formed in ground plane 52 using any suitable technique. For example, when ground plane 52 is formed from a printed circuit board substrate, slot 54 can be formed by patterning a conductive layer on the printed circuit board using wet or dry chemical etching (as examples). Other techniques may be used when forming slots in conductive housing walls. For example, slots may be machined in metal walls or other conductive wall structures in housing 12 using laser cutting, plasma arc cutting, micromachining (e.g., using grinding tools), or any other suitable techniques. Slots may also be formed by bringing two or more pieces together to form a structure with gaps between the pieces.

Slots may be formed in housing 12 (or other suitable ground plane elements 52) before such structures are assembled to form device 10 or after device 10 has been assembled. Slots are typically formed for antenna 20 after housing walls 12 have been formed, but before the other components of device 10 have been mounted in housing 12.

Slot 54 may have a natural resonant frequency. For example, slot 54 can have a natural resonant frequency with a wavelength that is four times the length of the slot (e.g., the length of slot 54 is one-quarter of a wavelength at its natural resonant frequency). Resonant frequencies are described herein as the frequency at which the impedance of a slot antenna is non-reactive (e.g., the reactance of the slot antenna's impedance is zero). In accordance with the present invention, by using impedance matching techniques described herein (e.g. by feeding the slot antenna at a suitable point while providing suitably enlarged ends), slot antennas are provided that have resonant frequencies at frequencies which are lower than the natural resonant frequency of an unmodified slot antenna. As a result, the length of the slot antennas of the present invention may be reduced without a corresponding increase in their resonant frequencies.

Antenna 20 may be used to cover two communications bands. With one suitable arrangement, the first band is the 2.4 GHz IEEE 802.11 "b" band and the second band is the 5 GHz IEEE 802.11 "a" band (sometimes referred to by its approximate center frequency of 5.4 GHz).

As shown schematically in the example of FIG. 3, a transmission line such as transmission line 22 may be used to convey radio-frequency signals between antenna 20 and radio-frequency transceiver circuitry such as radio-frequency transceiver circuitry 68. Transceiver circuitry 68 can include one or more transceivers for handling communications in one or more discrete communications bands. For example, transceiver circuitry 68 may be used to handle communications in 2.4 GHz and 5 GHz communications bands. Transceiver circuitry 68 may include a diplexer or other suitable circuitry for combining the signals associated with multiple individual transceivers. For example, transceiver circuitry 68 may include a 2.4 GHz transceiver, a 5 GHz transceiver, and a diplexer that allows the 2.4 GHz and 5 GHz transceivers to be connected to a common transmission line 22.

Transmission line 22 is coupled to antenna 20 at feed terminals 70 and 72. Feed terminal 70 can be referred to as a ground or negative feed terminal and is shorted to the outer (ground) conductor of transmission line 22. Feed terminal 72 can be referred to as the positive antenna terminal. Transmission line center conductor 74 is used to connect transmission line 22 to positive feed terminal 72. If desired, other types of antenna coupling (e.g., feed) arrangements can be used (e.g., based on near-field coupling, using impedance matching networks, etc.).

As shown schematically by dashed line 76, the feed arrangement for antenna 20 may include a matching network. Matching network 76 can include a balun (to match an unbalanced transmission line to a balanced antenna) and/or an impedance transformer (to help match the impedance of the transmission line to the impedance of the antenna).

The location of feed terminals 70 and 72 can be adjusted so that the input impedance of antenna 20 matches the impedance of transmission line 22. In the FIG. 3 example, the feed terminals (e.g., feed terminals 70 and 72) are located such that there is a length $L_1$ of slot 54 between the feed location and the open end of slot 54 and such that there is a length $L_2$ of slot 54 between the feed location and the closed end of slot 54.

The impedance of antenna 20 can be modeled as the parallel combination of the impedance of slot 54 along length $L_1$ and the impedance of slot 54 along length $L_2$. For example, if the impedance of slot 54 along length $L_2$ is ZinA and the impedance of slot 54 along length $L_1$ is ZinB, then the overall input impedance of antenna 20 is Zin, as shown in equation 1.

$$Zin=(ZinA^{-1}+ZinB^{-1})^{-1} \quad (1)$$

The impedance of slot 54 along lengths $L_1$ and $L_2$ (e.g., ZinB and ZinA, respectively) is modeled as a combination of resistive and reactive components. As an example, the impedance of one of the lengths of slot 54 is modeled with a complex number such that its resistance is represented by a real component (e.g., R) and its reactance is represented by an imaginary component (e.g., X), as shown in equations 2 and 3, where j equals the square root of negative one.

$$ZinA=R+jX \quad (2)$$

$$ZinB=R-jX \quad (3)$$

The R in equation 2 may have the same value as the R in equation 3 and, similarly, the X in equation 2 may have the same value as the X in equation 3. The situation in which the values of R and X of equation 2 have the same magnitude as the R and X values of equation 3 can be satisfied by adjusting the properties of antenna 20. Attributes that may be adjusted include the location of feed points 72 and 74, the design of matching network 76, the width of slot 54, the length of slot 54, etc. As an example, if the slot is approximately a quarter of a wavelength in length, the value of R may be about 32 ohms. This can be reduced (e.g., to about 5 ohms) by reducing the slot length to be much less than a quarter of a wavelength. If desired, antenna 20 can be adjusted so that the impedance of slot 54 along length $L_1$ has a resistive component (R) that is equal to the resistive component (R) of the impedance of slot 54 along length $L_2$ and has a reactive component (X) that is equal and opposite to the reactive component (X) of the impedance of slot 54 along length $L_2$.

When the reactive component of impedances ZinA and ZinB are equal in magnitude and opposite in sign, the reactances of impedances ZinA and ZinB cancel each other when combined as Zin. For example, when the magnitudes of X in equations 2 and 3 are equal, the impedance of antenna 20 is real (e.g., the impedance has a resistive component and lacks a reactive component) and is equal to the parallel combination of ZinA and ZinB, as shown in equation 4.

$$Zin=(R^2+X^2)/(2R) \quad (4)$$

This represents a resonant condition, which is generally desirable in making designs more efficient and amenable to impedance matching. Because impedance Zin of equation 4 is real (i.e., because the imaginary components which were used to represent reactance have canceled out), the impedance of antenna 20 (e.g., Zin) is at least approximated as a simple resistance (i.e., having no reactance).

Figure 4:
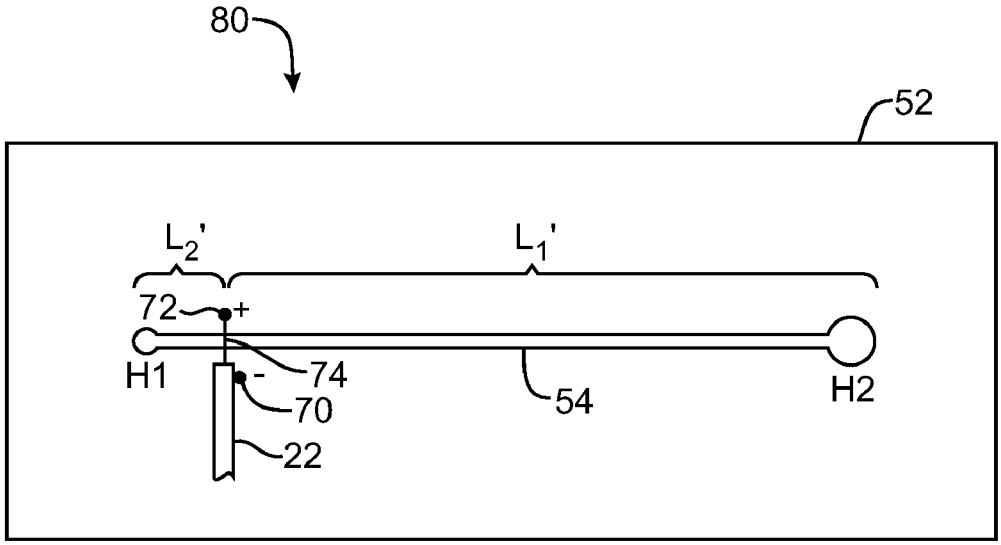
FIG. 4 is a top view of an illustrative slot antenna that has two circular terminations in accordance with an embodiment of the present invention.

An illustrative slot antenna structure having enlarged end portions is shown in FIG. 4. As shown in FIG. 4, antenna 80 may have enlarged terminations such as circular terminations (holes) H1 and H2 instead of the open and closed terminations of antenna 20 of FIG. 3. While impedances ZinA and ZinB are not shown to reduce visual clutter in FIG. 4, the input impedance of antenna 80 may be modeled as the parallel combination of ZinA and ZinB (e.g., in a similar fashion to the impedance of antenna 20). The input impedance of slot 54 along length $L_1$' is ZinB and the input impedance of slot 54 along length $L_2$' is ZinA.

Because antenna 80 of FIG. 4 has circular terminations H1 and H2 (rather than the open and closed terminations that are part of antenna 20), the impedance ZinA and ZinB are different than for antenna 20 of FIG. 3. These differences may allow the total length of antenna 80 ($L_1$' plus $L_2$') to be less than the total length of antenna 20 (e.g., $L_1$ plus $L_2$). The impedance of antenna 80 is at least partly configured by adjusting the location of the feed point (e.g., the location of feed points 70 and 72 along the length of slot 54) so that the impedance of antenna 80 is matched to the impedance of line 22.

Figure 5:
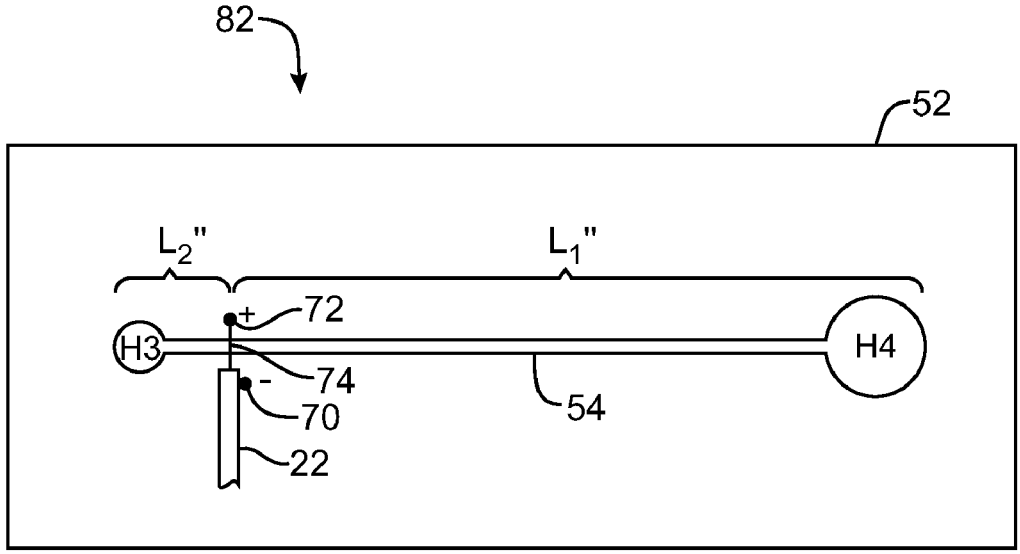
FIG. 5 is a top view of an illustrative slot antenna that has two circular terminations at least one of which is larger than the illustrative circular terminations illustrated in FIG. 4 in accordance with an embodiment of the present invention.

As shown in FIG. 5, an illustrative antenna such as antenna 82 can have circular terminations H3 and H4. The circular terminations of antenna 82 are larger than the circular terminations of antenna 80. The larger circular terminations of antenna 82 (e.g., H3 and H4) allow antenna 82 to be designed with a shorter overall length while at least maintaining (and possibly improving) antenna performance (efficiency and bandwidth) as compared with the performance of antenna 80. For example, the overall length of antenna 82 (e.g., length $L_1$" plus length $L_2$") is less than the overall length of antenna 80 (e.g., length $L_1$' plus length $L_2$'). The impedance of antenna 82 is at least partly configured by adjusting the location of feed points 70 and 72 along the length of slot 54.

While the impedances ZinA and ZinB are not shown in FIG. 5 (to reduce visual clutter), the impedance of antenna 82 can be modeled as the parallel combination of ZinA and ZinB (e.g., in a similar fashion to the impedance of antenna 20). The impedance of slot 54 along length $L_1$" is ZinB and the impedance of slot 54 along length $L_2$" is ZinA. If desired, antennas 80 and 82 can include matching networks such as matching network 76 of FIG. 3.

Antenna structures such as antenna 80 and antenna 82 with reduced lengths (e.g., reduced dimensions parallel to axis 60 of FIG. 3) have increased bandwidth. Antennas such as antennas 80 and 82 with reduced lengths or that lack open terminations also exhibit increased structural integrity (e.g., be less prone to damage). For example, when a device containing a slot antenna such as antennas 20, 80, or 82 is dropped, the slot antenna will physically vibrate (e.g., be excited). Slot antennas that are shorter tend to exhibit higher frequency mechanical resonances and are therefore be less likely to deform or break when excited (e.g., when the slot antenna and ground plane experience an abrupt shock from an impact). Circular terminations such as terminations H1, H2, H3, and H4 may also have increased physical integrity compared to terminations that have edges such as square terminations.

Figure 6:
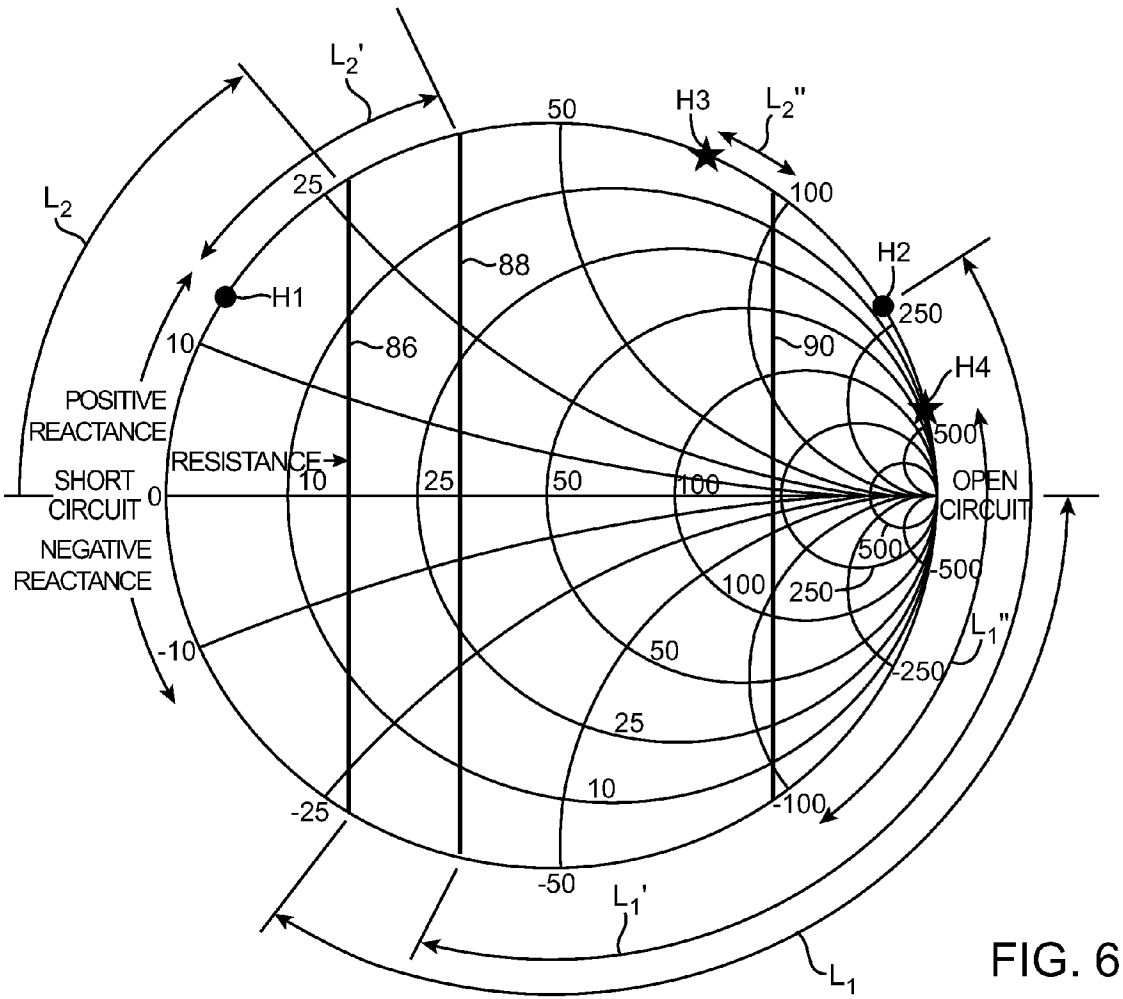
FIG. 6 is an illustrative Smith chart that may be used to analyze impedances associated with illustrative slot antennas in accordance with an embodiment of the present invention.

An illustrative Smith chart that can be used in characterizing impedances associated with slot antennas such as slot antennas 20, 80, and 82 is shown in FIG. 6. The Smith chart of FIG. 6 may be used in modeling the impedances of slot antennas to generate functional designs for those slot antennas. For example, a Smith chart can be used in determining a suitable feed location and a proper length for a slot antenna that is configured to operate at one or more (resonant) frequencies such that the impedance of the slot antenna is resistive and not reactive (e.g., so that impedance Zin is dominated by resistance).

A short circuit termination such as the closed circuit termination on length $L_2$ of antenna 20 generally has a resistance of zero ohms and a reactance of zero ohms. The impedance of a short circuit is therefore plotted in the middle of the left side of the Smith chart of FIG. 6 (e.g., on the zero ohm resistance circle and the zero ohm reactance curve).

An open circuit termination such as the open slot termination on length $L_1$ of antenna 20 is modeled as having infinite resistance and infinite reactance. The impedance of an open circuit is plotted in the middle of the right side of the Smith chart of FIG. 6 (e.g., at the point where the resistance and reactance curves asymptotically diverge towards an infinite value).

The impedance of antenna 20, and more particularly, the impedance of the two lengths of slot 54 (ZinA and ZinB) is represented by points that lie on line 86. For example, the impedance of slot 54 along length $L_2$ (ZinA) can be represented by a point in the upper left portion of the Smith chart (e.g., on the upper half of line 86) while the impedance of slot 54 along length $L_1$ (ZinB) can be represented by a point in the lower left portion of the Smith chart (e.g., on the lower half of line 86). In a similar fashion as the impedance of antenna 20, the impedance of antennas 80 and 82 are represented by points that lie on lines 88 and 90, respectively.

In order to ensure that the reactive components of ZinA and ZinB cancel out when combined in Zin, the actual impedances ZinA and ZinB can be equidistant from the zero reactance line (e.g., with ZinA being above and ZinB being below the zero reactance line). This ensures that the impedance of a slot antenna (e.g., Zin) is dominated by a resistive component.

The length $L_2$ of antenna 20 can be represented in the Smith chart by the length of the perimeter of the Smith chart moving clockwise from the short circuit termination to the upper portion of line 86 (as illustrated in FIG. 6 by line $L_2$). If the length $L_2$ were increased, as an example, line 86 would generally move towards the right of the Smith chart. The length $L_1$ of antenna 20 may be represented by the length of the perimeter of the Smith chart moving clockwise from the open circuit termination to the lower portion of line 86 (as illustrated by line $L_1$ in FIG. 6).

The slot terminations shown in FIGS. 4 and 5 may be effectively modeled as inductive loads. The inductive reactance of a hole increases monotonically (at least within a first order approximation) with the area of the termination (e.g., with the surface area of the opening of the termination). The shape of the termination has a relatively smaller effect than the area of the termination. Therefore, circular openings in circular terminations H1, H2, H3, and H4 may be replaced with square openings (terminations). A square opening is effectively a slot, which is as wide as it is long, so it can be modeled as a short length of short-circuited slot line, which is inductive in nature.

Depending on the size (area) of the opening in a termination, the impedance of the termination varies from slightly reactive (e.g., resulting from its small inductance) to larger reactances as the size and inductance of the termination increases. In the limit of an infinitely large opening, the impedance of the termination is that of an open circuit termination. For example, a termination with an opening that is approximately three millimeters in diameter may approximate a terminator larger than fifty ohms at frequencies of two gigahertz.

Because the resistance of a termination with an enlarged opening such as terminations H1, H2, H3, or H4 is low, the impedance of a termination may be plotted near the zero resistance circle of the Smith chart (e.g., along the top edge of the chart). As the opening in a termination increases in size, the impedance of the termination rotates clockwise around the perimeter of the Smith chart of FIG. 6 (e.g., clockwise from the short circuit impedance towards the open circuit impedance). For example, termination H1 has the impedance indicated at H1 which is approximately at zero ohms of resistance and fifteen ohms of reactance. Termination H2 has an impedance that is indicated at H2 and which is just under two-hundred and fifty ohms of reactance. Termination H3 has an impedance that is indicated at H3 and termination H4 has the impedance indicated at H4.

Recalling that the lengths $L_1$ and $L_2$ of antenna 20 could be represented in the Smith chart by the arc lengths of the perimeters ($L_1$ and $L_2$) of the chart, replacing the terminations of antenna 20 with terminations of the type shown in FIG. 3 or 4 allows for slot antennas with reduced lengths (e.g., without sacrificing the impedance match with transmission line 22). As the impedance of slot 54 along each direction of one of the slot antennas (e.g., antenna 20, 80, or 82) is modified through the addition of terminations with openings of ever increasing size, slot line length A (e.g., the length corresponding to ZinA such as lengths $L_2$, $L_2'$, or $L_2''$) is reduced. When the open circuit termination is replaced by a termination with an opening that approximates an open circuit, slot line length B (e.g., the length corresponding to ZinB such as length $L_1$, $L_1'$, or $L_1''$) is increased. Because the increase in length B can be more than offset by the reduction in length A, slot antennas with enlarged terminations (e.g., antennas of the type shown in FIGS. 3 and 4) have reduced overall lengths while still maintaining an input impedance suitable for coupling with transmission line 22 (e.g., roughly 50 ohms with a negligible reactance).

The length of antenna 80 may be given by the sum of lengths $L_1'$ and $L_2'$ (e.g., clockwise from H1 to the top of line 88 and clockwise from H2 to the bottom of line 88). The length of antenna 82 may be given by the sum of lengths $L_1''$ and $L_2''$ (e.g., clockwise from H3 to the top of line 90 and clockwise from H4 to the bottom of line 90). The lengths of antennas 80 and 82 are noticeably shorter than half a circular arc around the Smith chart, or less than the length of slot antenna 20 (e.g., one-quarter of wavelength at the resonant frequency).

Slot antennas 20, 80, and 82 can be configured as dual-band slot antennas. For example, slot antennas 20, 80, and 82 can be configured to operate in the IEEE 802.11 band at 2.4 GHz (e.g., the "b" band) and the IEEE 802.11 band at 5 GHz (e.g., the "a" band).

Figure 7:
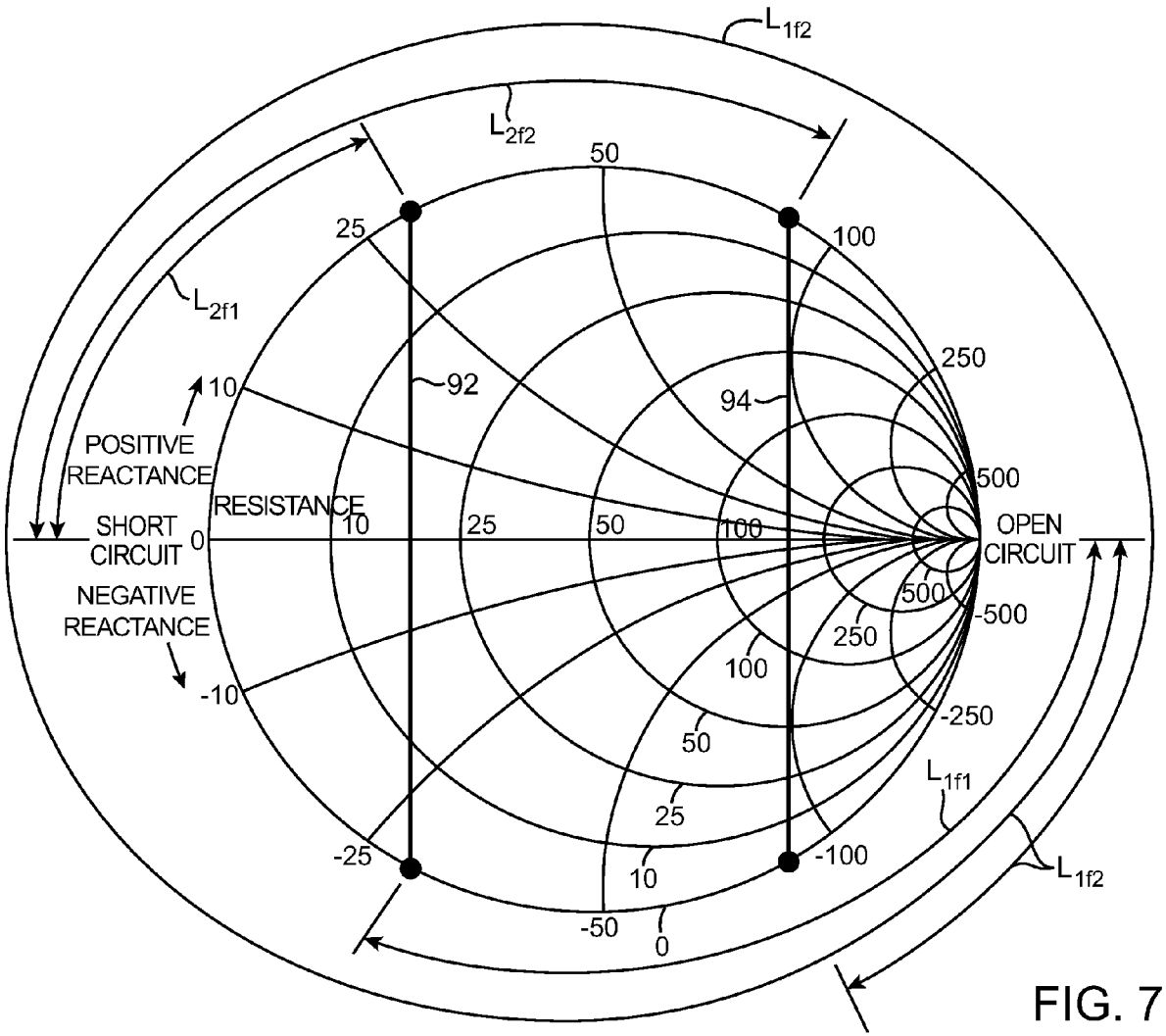
FIG. 7 is an illustrative Smith chart that may be used to analyze impedances associated with illustrative dual-band slot antennas in accordance with an embodiment of the present invention.

An illustrative Smith chart that may be used to model impedances for dual-band slot antennas such as slot antennas 20, 80, and 82 is shown in FIG. 7. The Smith chart of FIG. 7 may be used in modeling the impedances of dual-band slot antennas to help determine the proper feed location and length of dual-band slot antennas that are configured to be impedance matched to transmission line 22 at the two radio-frequency bands the dual-band slot antennas operate in. For example, the Smith chart of FIG. 7 may be used to design dual-band slot antennas such that, at the IEEE 802.11 "b" band (e.g., 2.4 GHz) and at the IEEE 802.11 "a" band (e.g., roughly 5 GHz), the dual-band slot antennas are impedance matched with transmission line 22.

In the FIG. 7 example, the Smith chart is being used to model the impedances of a dual-band slot antenna of the type shown in FIG. 3 (i.e., antenna 20). Line 92 represents impedances of the dual-band slot antenna such as dual-band antenna 20 at a first resonant frequency (e.g., the 2.4 GHz band or the IEEE 802.11 "b" band). Line 94 represents impedances of the dual-band slot antenna at a second resonant frequency (e.g., the 5 GHz or the IEEE 801.11 "a" band).

As illustrated in FIG. 7, the reactive components of the impedance of the dual-band slot antenna are negligible. For example, at the first and second resonant frequencies (e.g., at lines 92 and 94), the reactance in the impedance of slot 54 along length $L_1$ (from FIG. 3) is equal and opposite to the reactance in the impedance of slot 54 along length $L_2$ so that the impedance of antenna 20 (e.g. Zin) has a negligible reactance component.

The Smith chart of FIG. 7 can be used in determining the proper feed position for dual-band antenna (e.g., the position of feed terminals 70 and 72 along slot 54). For example, length $L_1$ of slot 54 can be represented by perimeter $L_{1f1}$ at the first resonant frequency (e.g., line 92) and can be represented by perimeter $L_{1f2}$ at the second resonant frequency (e.g., line 94). Length $L_2$ of slot 54 is represented by perimeter $L_{2f1}$ at the first resonant frequency (e.g., line 92) and can be represented by perimeter $L_{2f2}$ at the second resonant frequency (e.g., line 94). By using terminations with enlarged ends of varying sizes, the perimeters $L_{1f1}$ and $L_{2f1}$ can be shortened and lengthened, respectively, to achieve a resonance condition (e.g., so that the input impedance of the slot has a reactance of zero at the second frequency). Slot 54 may also be configured to support radio-frequency communications in additional bands. For example, slot 54 can be configured to support communications in additional bands by adjusting the size of the ends and the feed point so that the additional bands are in the resonance condition where there is no reactance in the input impedance of the slot.

Figure 8:
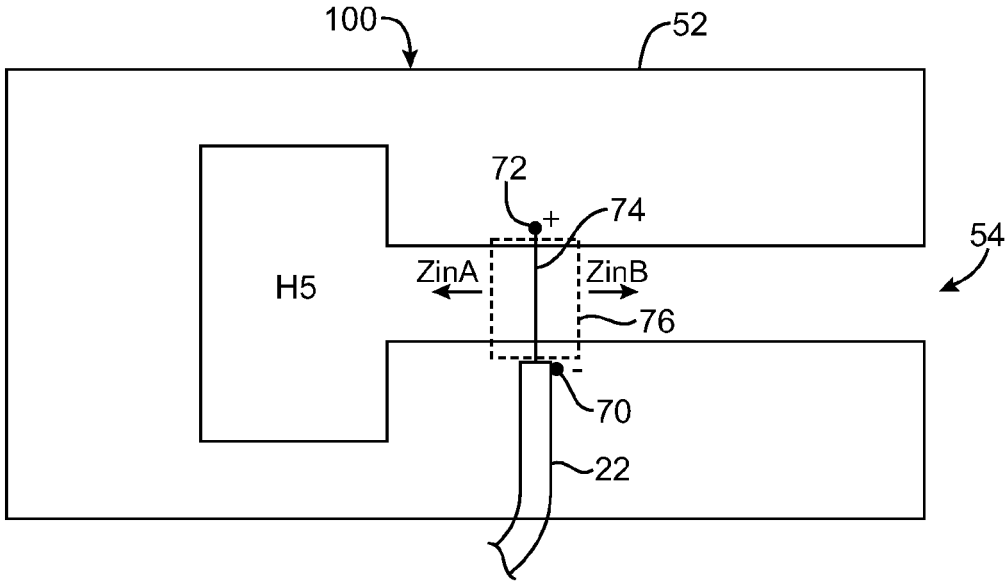
FIG. 8 is a top view of an illustrative slot antenna that has a square termination and an open circuit termination in accordance with an embodiment of the present invention.
Figure 9:
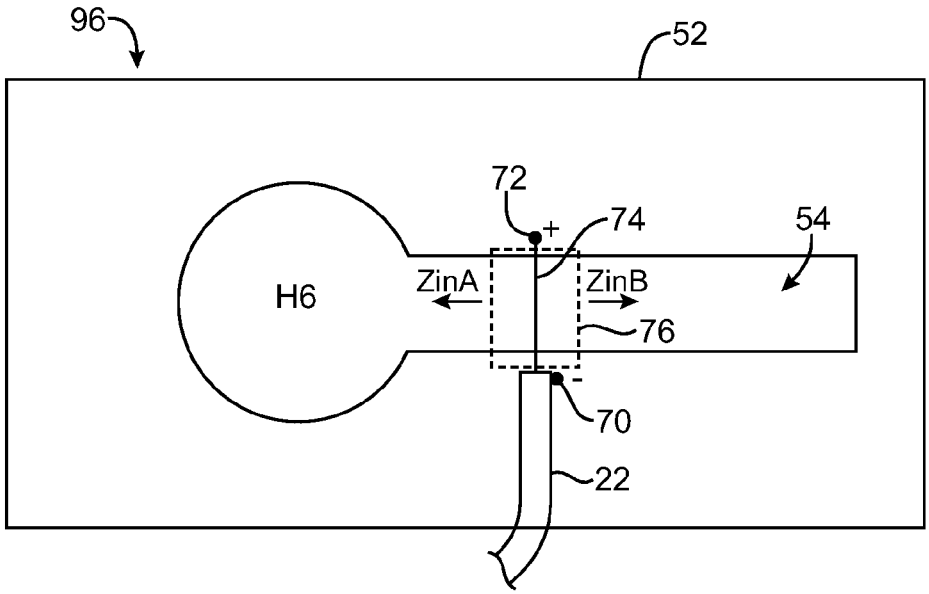
FIG. 9 is a top view of an illustrative slot antenna that has a circular termination and a closed circuit termination in accordance with an embodiment of the present invention.

FIGS. 8 and 9 illustrate that a slot antenna of the type shown in FIG. 3 can have a single termination with an opening in ground plane element 52 of any suitable shape and can have an open (FIG. 8) or closed (FIG. 9) termination. For example, FIG. 8 illustrates that slot antenna 100 may have a termination with a square or rectangular opening such as opening H5 and may have an open slot termination. Opening H5 can be any suitable shape and size and the open slot termination can be replaced with a short circuit termination or with an opening such as opening H5. For example, FIG. 9 illustrates that slot antenna 96 may have a termination with a circular opening such as opening H6 and may have a closed slot termination. A circular termination such as opening H6 can have any suitable size. For example, circular termination H6 may be 2.5 millimeters in diameter. By utilizing terminations with openings such as openings H5 and H6, the lengths of the slot antennas can be reduced when the antennas are configured for operation at a particular resonant frequency (e.g., fundamentally matched at a first RF band and harmonically matched at a second RF band). The use of a closed slot termination (e.g., as in FIG. 9) may increase the physical integrity or strength of slot antennas such as slot antenna 96.

Figure 10:
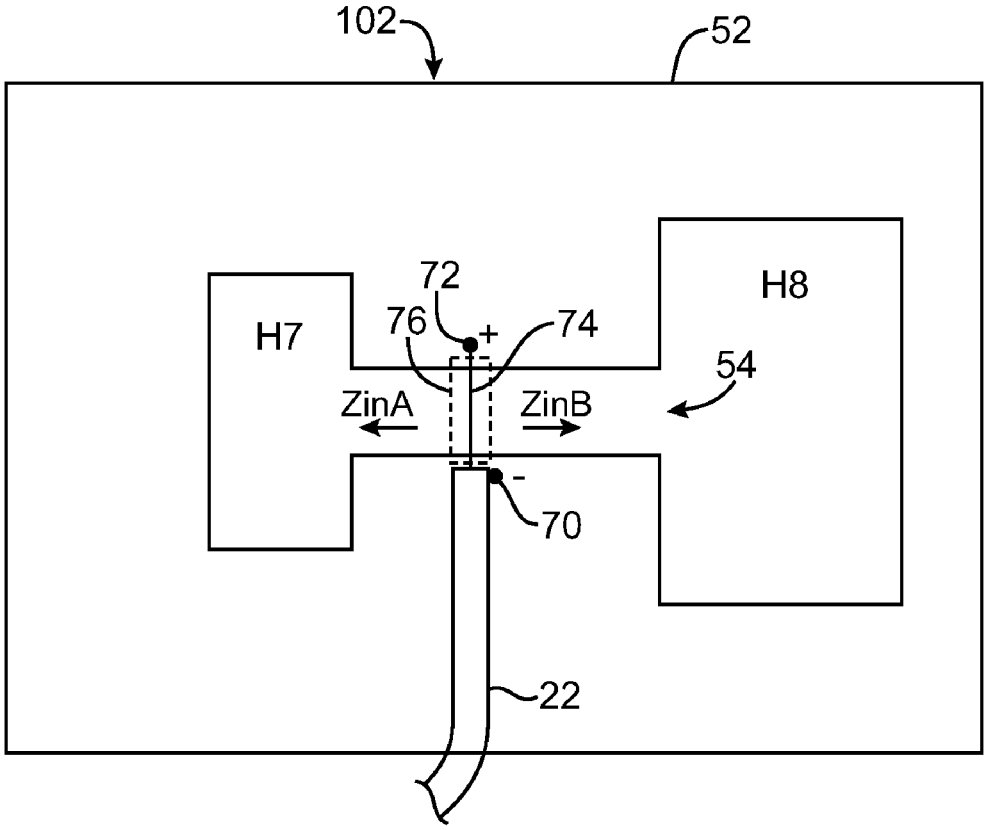
FIG. 10 is a top view of an illustrative slot antenna that has two square terminations in accordance with an embodiment of the present invention.

FIG. 10 illustrates slot antenna 102, which is similar to slot antennas of the type shown in FIGS. 4 and 5 (e.g., antennas 80 and 82), but that has square shaped terminations rather than circular terminations in accordance with one embodiment of the invention. Because the primary contribution to the impedance of slot 54 from a termination formed from an opening in element 52 results from the area of the opening rather than the shape of the opening, slot antennas with square terminations may have similar impedance characteristics as slot antennas with circular terminations such as antennas 80 and 82.

Figure 11A:
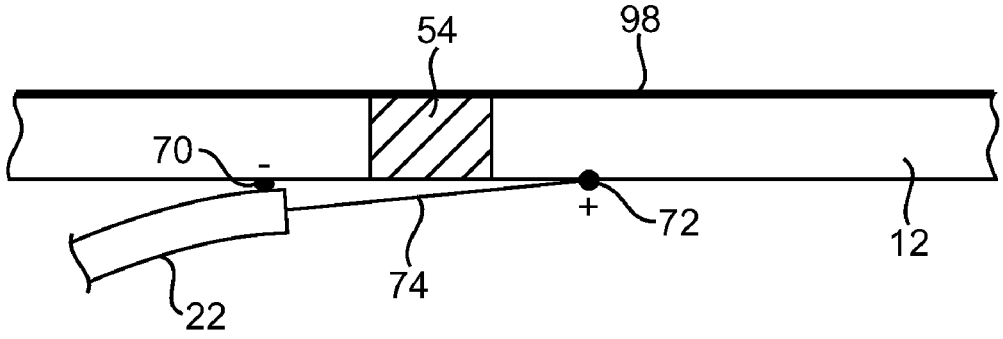
FIG. 11A is a side view of an illustrative slot antenna in accordance with an embodiment of the present invention.

FIG. 11A is a side view of a slot antenna such as antennas 20, 80, 82, 96, 100, and 102. As illustrated by FIG. 11A, transmission line 22, feed terminals 70 and 72, transmission line center conductor 74, and other portions of slot antennas are formed on the inside portions of a conductive housing such as housing 12 in the vicinity of slot 54. By forming portions of the antenna structures on the inside of housing 12, the slot antenna in housing 12 is less susceptible to damage and device 10 is more visually appealing. For example, the outside of housing 12 has a smooth surface over the slot antenna so that the outside of device 10 is visually appealing to a user.

Slot 54 can be filled with any suitable dielectric such as a gaseous dielectric, a solid dielectric, a porous dielectric, a foam dielectric, a gelatinous dielectric (e.g., a coagulated or viscous liquid), a dielectric with grooves, pores, a dielectric having a matrix, honeycombed, or lattice structure or having other structural voids, a combination of such dielectrics, etc. With one suitable arrangement, slot 54 is filled with a non-gaseous dielectric (e.g., a dielectric that is not air or another gas). If desired, the dielectric used to fill slot 54 can form a honeycomb structure, a structure with grooved voids, spherical voids, or other hollow shapes. If desired, the dielectric in slot 54 may be formed from epoxy, epoxy with hollow microspheres or other void-forming structures, etc. Porous dielectric materials used to fill slot 54 can be formed with a closed cell structure (e.g., with isolated voids) or with an open cell structure (e.g., a fibrous structure with interconnected voids). Foams such as foaming glues (e.g., polyurethane adhesive), pieces of expanded polystyrene foam, extruded polystyrene foam, foam rubber, or other manufactured foams can also be used to fill slot 54. It may be advantageous to fill slot 54 with nongaseous dielectric material so that foreign objects are prevented from entering device 10 through slot 54. An advantage of filling slot 54 with nongaseous materials that have low densities (e.g., nongaseous materials with voids) is that such materials generally have low dielectric constants, which tends to enhance the efficiency of antenna 20. If desired, the dielectric used to fill slot 54 can include layers or mixtures of different substances such as mixtures including small bodies of lower density material.

Optional dielectric coating 98 can be formed on the outside of housing 12. Dielectric coating 98 covers slot 54 (e.g., the dielectric in slot 54) and can visually and physically disguise slot 54 from a user of device 10. For example, coating 98 can be similar in color and texture to the color and texture of housing 12 or can be used to cover all or most of housing 12 (as an example). Coating 98 helps to prevent foreign objects, materials, dust, etc. from passing through slot 54 and entering device 10. If desired, coating 98 can be omitted. To prevent slot 54 from being visually noticeable in this type of arrangement, slot 54 can be filled with an epoxy or other dielectric with a similar appearance to the exterior of housing 12.

Figure 11B:
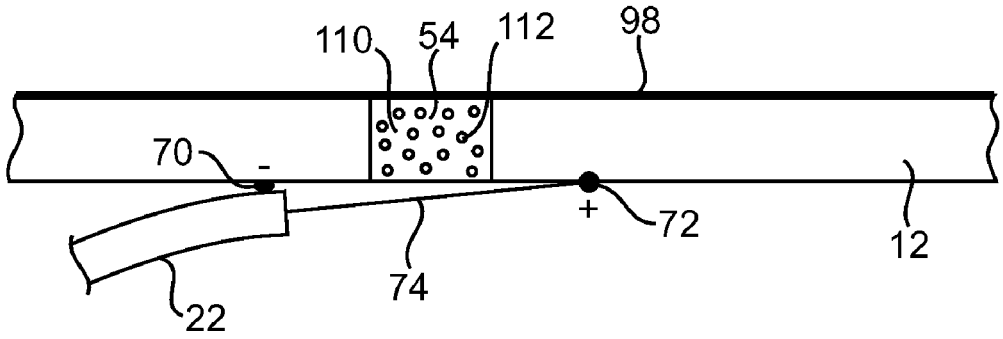
FIG. 11B is a side view of an illustrative slot antenna with a slot that is filled with a porous dielectric material in accordance with an embodiment of the present invention.

In the example of FIG. 11B, slot 54 is filled with a dielectric material such as material 110 that includes voids 112. Voids 112 may have a spherical shape or other suitable shape and may be formed from hollow microspheres, bubbles, etc. Voids 112 may be randomly distributed throughout a suitable non-gaseous dielectric such as epoxy.

The foregoing is merely illustrative of the principles of this invention and various modifications can be made by those skilled in the art without departing from the scope and spirit of the invention.

What is claimed is:

1. A slot antenna comprising:

a ground plane element having an elongated slot portion that is elongated along a first axis and having, at opposing ends of the elongated slot, first and second openings that are wider than the elongated slot portion along a second axis that is perpendicular to the first axis, wherein the first and second openings are different in size and wherein the elongated slot portion, the first opening, and the second opening are configured to handle radio-frequency signals at a first communications band and at a second communications band.

2. The slot antenna defined in claim 1 wherein the first and second openings respectively comprise first and second circular openings.

3. The slot antenna defined in claim 1 wherein the first and second openings respectively comprise first and second rectangular openings.

4. The slot antenna defined in claim 1 wherein the first communications band comprises a 2.4 GHz communications band, wherein the second communications band comprises a 5 GHz communications band, and wherein the elongated slot portion, the first opening, and the second opening are configured to handle radio-frequency signals at the 2.4 GHz communications band and at the 5 GHz communications band.

5. A slot antenna comprising:

a ground plane element having an elongated slot portion that is elongated along a first axis and having, at opposing ends of the elongated slot, first and second openings that are wider than the elongated slot portion along a second axis that is perpendicular to the first axis, wherein the first and second openings are different in size and wherein the slot antenna is fed at a feed point that is located at different respective distances from the opposing ends of the elongated slot portion.

6. The slot antenna defined in claim 1 further comprising:

a solid dielectric in the elongated slot portion and in the first and second openings.

7. A slot antenna comprising:

a ground plane element having an elongated slot portion that is elongated along a first axis, having, at a first end of the elongated slot, a first opening that is wider than the elongated slot portion along a second axis that is perpendicular to the first axis, and having, at a second end of the elongated slot, a second opening that is wider than the elongated slot portion along the second axis, wherein at least one of the first and second openings is substantially symmetrical about the first axis; and a solid dielectric in the slot and in the first opening.

8. The slot antenna defined in claim 7 wherein the elongated slot portion has a width of less than four-tenths of a millimeter and wherein the slot has a length of less than fifty millimeters.

9. The slot antenna defined in claim 7 wherein the elongated slot portion and the first opening are configured to handle radio-frequency signals at a first communications band and at a second communications band.

10. The slot antenna defined in claim 7 wherein the elongated slot portion and the first opening are configured to handle radio-frequency signals at a 2.4 GHz communications band and at a 5 GHz communications band.

11. The slot antenna defined in claim 7 wherein the solid dielectric comprises epoxy.

12. A slot antenna comprising:

a ground plane element having an elongated slot portion that is elongated along a first axis and having, at a first end of the elongated slot portion, a first opening that is wider than the elongated slot portion along a second axis that is perpendicular to the first axis, wherein the slot antenna comprises a dual-band antenna and wherein the slot portion and the first opening are configured to handle radio-frequency signals at a first communications band and at a second communications band.

13. The slot antenna defined in claim 12 wherein the first communications band is a 2.4 GHz communications band, wherein the second communications band is a 5 GHz communications band, the slot antenna further comprising:

a nongaseous dielectric in the elongated slot portion.

14. The slot antenna defined in claim 12 further comprising:

a nongaseous dielectric with voids in the elongated slot portion.

15. The slot antenna defined in claim 12 wherein the first opening comprises a first circular opening that is directly connected to the elongated slot portion.

16. The slot antenna defined in claim 15 wherein the second opening comprises a second circular opening that is directly connected to the elongated slot portion.

17. The slot antenna defined in claim 12 wherein the first and second openings respectively comprise first and second rectangular openings that are directly connected to the elongated slot portion.

18. The slot antenna defined in claim 12 wherein the elongated slot portion has a width of less than four-tenths of a millimeter and wherein the elongated slot portion has a length of less than fifty millimeters.

* * * * *